US006429826B2

(12) United States Patent
Karlsson et al.

(10) Patent No.: US 6,429,826 B2
(45) Date of Patent: Aug. 6, 2002

(54) ARRANGEMENT RELATING TO REFLECTOR ANTENNAS

(75) Inventors: Håkan Karlsson; Jonas Flodin, both of Gothenburg (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/748,185

(22) Filed: Dec. 27, 2000

(30) Foreign Application Priority Data

Dec. 28, 1999 (SE) ..... 9904814

(51) Int. Cl.[7] ..... H01Q 19/19
(52) U.S. Cl. ..... 343/781 P; 343/781 CA
(58) Field of Search ..... 343/781 P, 781 CA, 343/781 R, 786, 840, 837, 914, 779, 782, 783

(56) References Cited

U.S. PATENT DOCUMENTS

| | | | | |
|---|---|---|---|---|
| 4,963,878 A | | 10/1990 | Kildal | 343/781 P |
| H1034 H | * | 3/1992 | Lohrmann | 343/781 LA |
| 5,959,590 A | * | 9/1999 | Sanford et al. | 343/781 CA |
| 5,973,652 A | | 10/1999 | Sanford et al. | 343/781 P |

FOREIGN PATENT DOCUMENTS

| | | |
|---|---|---|
| EP | 0284897 | 6/1992 |
| GB | 2096400 | 10/1982 |
| WO | WO87/07771 | 12/1987 |
| WO | WO99/10950 | 3/1999 |

OTHER PUBLICATIONS

"Fixed Radio Systems; Point to Point Antennas; Antennas for point–to–point fixed radio systems opertating in the frequency band 3 GHz to 60 GHz", ETSI EN 300 833 v 1.2.1 (200–08), pp. 1–33, published by ETSI, 650 Route des Lucioles, F–06921 Sophia Antipolis Cedex—FRANCE.

* cited by examiner

*Primary Examiner*—Don Wong
*Assistant Examiner*—James Clinger
(74) *Attorney, Agent, or Firm*—Burns, Doane, Swecker & Mathis, L.L.P.

(57) ABSTRACT

The present invention relates to the field of arrangements in reflector antennas, and in particular to that part of this field that concerns reflector antennas that include subreflectors. The invention is concerned chiefly with an improved sub-reflector (5*b*) which when used in a reflector antenna (1) enables the antenna to obtain a radiation diagram with high suppression of side lobes in both the H-plane and the E-plane. The reflective structure of the subreflector (5*b*) includes at least two mutually different geometries (15, 17) that have been configured specifically to obtain radiation diagrams with good suppression of side lobes in both the E-plane and the H-plane.

12 Claims, 3 Drawing Sheets

ARRANGEMENT RELATING TO REFLECTOR ANTENNAS

FIELD OF INVENTION

The present invention relates to the field of arrangements relating to reflector antennas, and in particular to that part of this field concerned with reflector antennas that include subreflectors.

BACKGROUND OF THE INVENTION

Many technical applications include some form of antenna function for sending or receiving radio signals. Examples of such applications are radio apparatus, TV apparatus, mobile telephony systems, radio communication links and radar systems.

The requirement placed on the directional effect of an antenna varies in accordance with the application concerned. A radio apparatus shall be capable of receiving signals from different radio stations, regardless of where the apparatus is located, and the antenna should therefore be equally as receptive in all directions in a horizontal plane. On the other hand, a TV receiver shall only be receptive to signals arriving from the nearest TV mast or from a TV satellite. Thus, the antenna of a TV receiver should be positioned so that it is particularly receptive to signals arriving from a certain direction, and signals that arrive from other directions shall be suppressed to the greatest possible extent. This also applies, for instance, to antennas for radio links. Radar apparatus shall normally both transmit and receive in a certain direction, which shall also be capable of being changed so that the radar can receive omnidirectional information relating to the surroundings. It is also desirable in respect of radar apparatus that the antenna will function to suppress signals from directions other than the direction in which the radar currently transmits and receives at that moment in time.

A common type of directional antenna is the so-called reflector antenna. A reflector antenna will normally include a main reflector and a feed. The feed is placed in front of the main reflector and is adapted to transmit or receive electromagnetic radiation reflected onto the main reflector. A common type of feed includes a waveguide or corresponding device, and a subreflector. In the transmission of electromagnetic radiation, the waveguide is excited to deliver electromagnetic radiation of a predetermined kind. The radiation emitted from the waveguide is first reflected against the subreflector and then against the main reflector. Electromagnetic signals can also be received by the reflector antenna. In the case of reception, the beam path will, of course, travel in the reverse direction to that travelled in the case of transmission. The dimensions of the main reflector are conveniently much larger than the wavelength of the signals used in the application in question. The main reflector is formed to combine signals that are transmitted (or are incoming) in a certain direction, in a manner that is suitable in the context concerned. The directional sensitivity, or receptiveness, of the reflector antenna can be changed by realigning the antenna mechanically.

Technical specifications have been compiled in order to characterise the quality of the directional properties of reflector antennas. For instance, ETSI (European Telecommunications Standard Institute) have produced a specification—ETS 300 833—that specifies radio link antenna requirements. The specification states requirements concerning the radiation diagram of the reflector antenna in a horizontal plane. For a number of frequency ranges, the specification states, inter alia, the requirement regarding side lobe levels (both with regard to co-polarisation and cross-polarisation). Several numbered classes are specified for each frequency range and the greater the number, the stricter the requirements placed on the suppression of side lobes.

In order to better utilise the radio frequency spectrum, it is usual to adapt radio link antennas for the use of either horizontal polarisation (horizontal E-field) or vertical polarisation (vertical E-field). It is, of course, beneficial if one and the same reflector antenna can be used for both horizontal polarisation and vertical polarisation, for instance by rotating the feed and the subreflector. In order to make this possible, it is therefore necessary for the reflector antenna to be adapted to enable the quality requirements placed on the radiation diagram (for instance, in accordance with the above-mentioned ETSI specification) to be achieved both in an E-plane in respect of horizontal polarisation and in an H-plane in respect of vertical polarisation.

WO, A1, 87/07771 teaches a reflector antenna comprising a feed—a so-called hat feed—that includes a subreflector. It would appear that the subreflector is constructed, inter alia, to achieve with the reflector antenna a radiation diagram which in an H-plane coincides with a radiation diagram in an E-plane to the greatest possible extent. The subreflector is rotationally symmetrical about a centre axis and includes a centrally positioned conical spreader which is intended to be placed in front of the aperture of a waveguide in the feed. That part of the reflective structure of the subreflector located outside the spreader is essentially planar, although it includes circular corrugations (grooves) of a constant depth correspond approximately to one-quarter wavelength. The construction of the subreflector also enables the hat feed to be made very compact.

Reflector antennas that include hat feeds function very efficiently in general. However, reflector antennas that include a hat feed do not function satisfactorily in some cases. For instance, when measuring at high frequencies on a 0.3 m reflector antenna that included a hat feed, it was found that the reflector antenna was unable to meet the requirements of ETSI class 3 (30–47 GHz) in the H-plane. The radiation exceeded specified levels in the region nearest the main lobe and for angles around 60° in relation to the main lobe (so-called spillover lobes, in other words direct radiation from the feed that failed to impinge on the main reflector). The reflector antenna equipped with the hat feed essentially met the requirements of ETSI class 3 in respect of the E-plane.

One drawback with the hat feed is thus that it is unable to achieve a radiation diagram with high suppression of side lobes in both the H-plane and the E-plane under all circumstances.

SUMMARY OF THE INVENTION

The present invention addresses chiefly the problem of obtaining an improved subreflector which, when used in a reflector antenna, enables the reflector antenna to obtain a radiation diagram with high suppression of side lobes in both the H-plane and the E-plane.

In brief, the problem addressed above is solved by providing the subreflector with an improved reflective structure.

Accordingly, one object of the invention is to provide a subreflector that is an improvement with respect to achieving radiation diagrams of predetermined quality in different planes, wherein the invention also includes a feed that includes one such subreflector and also a reflector antenna that includes such a subreflector.

More specifically, the above addressed problem is solved as follows: The reflective structure of the subreflector includes at least two different geometries which have been designed specifically to obtain radiation diagrams that have effective suppression of side lobes in both the E-plane and the H-plane.

An essential advantage afforded by the invention is that it enables the procurement of reflector antennas that can be used for both horizontal polarisation and vertical polarisation in applications where high quality is required of the reflector antenna radiation diagram in a horizontal plane (or in a vertical plane).

The invention will now be described in more detail with reference to preferred exemplifying embodiments thereof and also with reference to the accompanying drawings.

DESCRIPTION OF PREFERRED EMBODIMENTS

Figure 1:
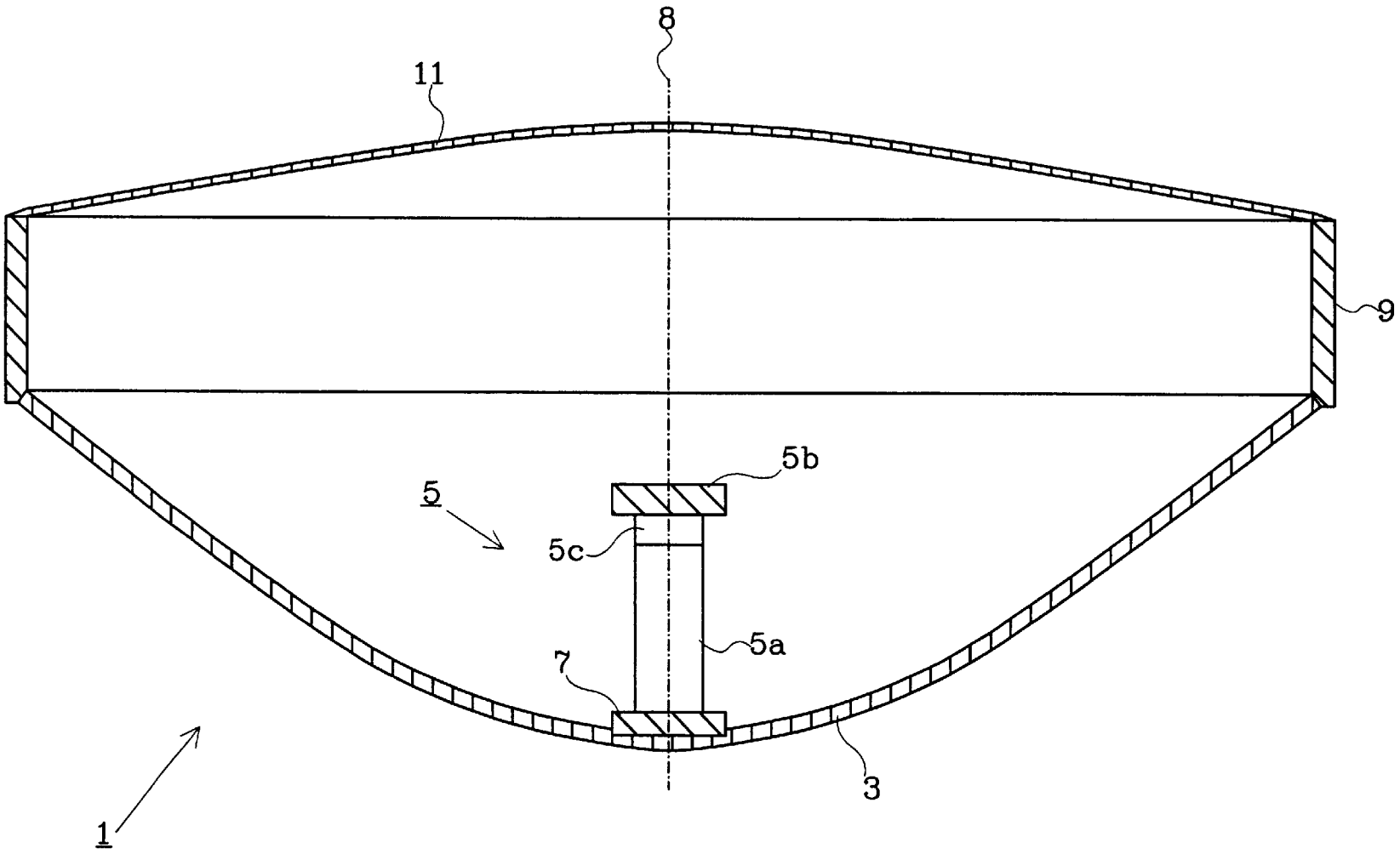
FIG. 1 is a sectioned view of a reflector antenna.

FIG. 1 is a cross-sectional view of one embodiment of the invention that includes a reflector antenna 1. The reflector antenna 1 includes a dish-shaped main reflector 3 (generally parabolic) and a feed element 5 mounted on a vertex plate 7 located centrally in the main reflector 3. The feed element 5 is disposed along a centre axis 8 of the main reflector 3 and includes a waveguide 5*a*, a subreflector 5*b* and a holder 5*c* that functions to secure the subreflector 5*b* in a predetermined position relative to the waveguide 5*a*. In the illustrated embodiment, the waveguide 5*a* has a circular cross-section, although it may, alternatively, have some other cross-sectional shape, such as a rectangular shape. The waveguide 5*a* is adapted for excitation to a predetermined propagation mode, for instance TE11. A tubular attenuator 9 has a first edge that lies against the edge of the main reflector 3. The material composition of the attenuator 9 and its dimensions are adapted so that the attenuator 9 will suppress spillover lobes. A radome 11 is disposed at the other edge of the attenuator 9, this edge being opposite to said first edge.

Figure 2:
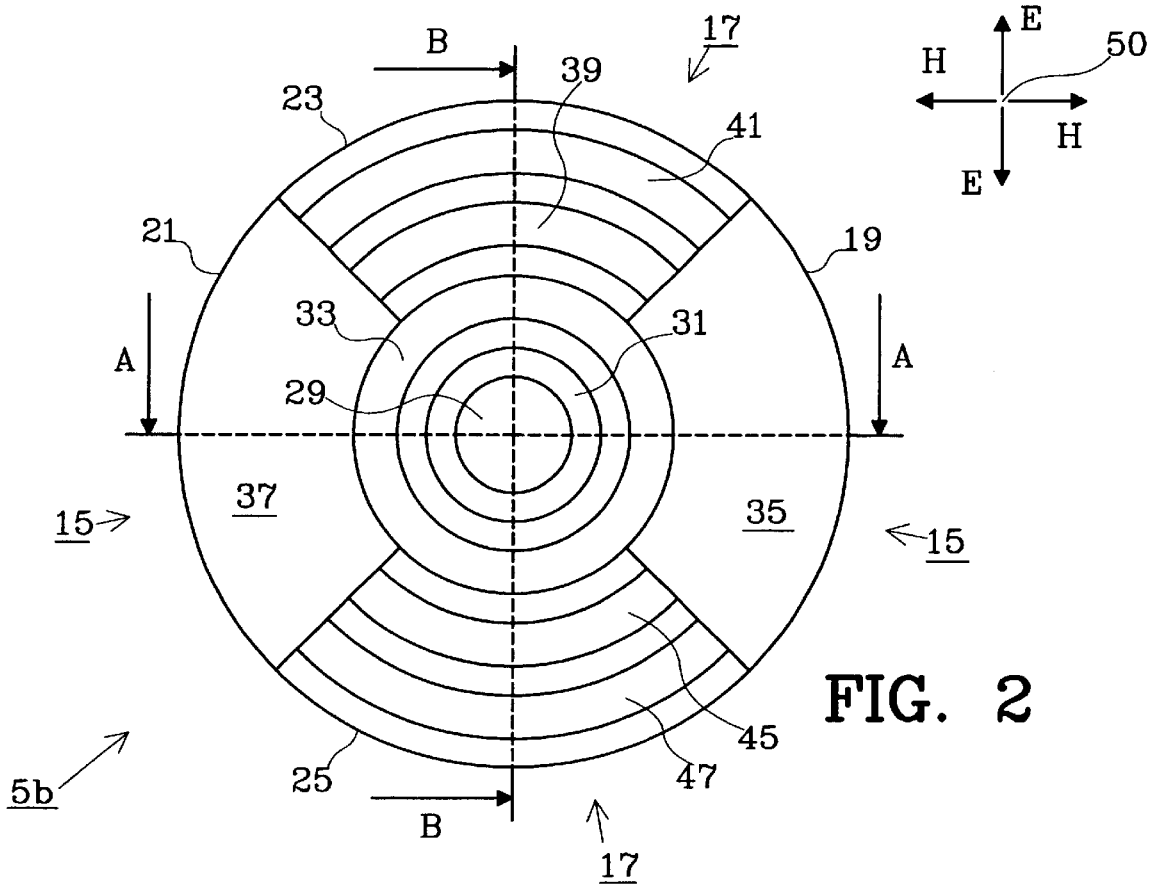
FIG. 2 is a plan view of a subreflector of the reflector antenna.

FIG. 2 is a plan view that illustrates the subreflector 5*b* in more detail, from its reflective side. In the illustrated case, the subreflector 5*b* has a circular periphery. The reflective structure of the subreflector 5*b*, however, is not rotationally symmetrical. Instead, the subreflector 5*b* includes different reflective geometries that have specially adapted properties. For instance, the subreflector 5*b* includes a first reflective geometry 15 in mutually opposing first and second sectors 19 and 21. The subreflector 5*b* also includes a second reflective geometry 17 in mutually opposing third and fourth sectors 23 and 25 that are perpendicular in relation to the first and the second sectors 19 and 21.

Figure 3:
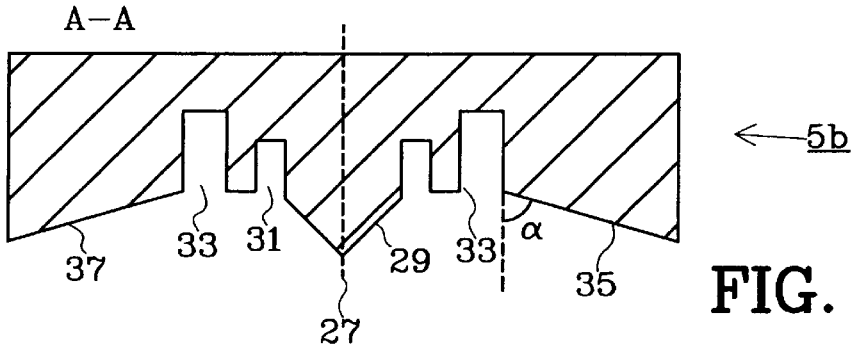
FIG. 3 is a first sectioned view of the subreflector.

FIG. 3 is a sectional view of the subreflector 5*b*, taken on the line A—A in FIG. 2. The section A—A is taken through a first plane that includes a centre axis 27 of the subreflector 5*b* and that divides said first and second sectors 19 and 20 centrally in two. The first plane constitutes an H-plane when using the subreflector, in other words the first plane is parallel with the magnetic field strength (H) of an electromagnetic field 50 reflected by the subreflector 5*b*. The section A—A illustrates the design of the first geometry 15. The first geometry 15 includes nearest the centre axis 27 a conical spreader 29 which the first geometry 15 shares with the second geometry 17. A first corrugation (groove) 31 is located outside the spreader 29. This first corrugation has a circular configuration whose centre point lies on the centre axis 27 of the subreflector 5*b*. The first corrugation 31 thus passes through all four sectors 19, 21, 23 and 25, and is thus common to the first and the second geometries 15 and 17 respectively. In addition to contributing towards the reflective properties of the subreflector 5*b*, the first corrugation 31 has the function of providing means for anchoring the subreflector 5*b* to the holder 5*c*, as will be made apparent hereinafter. Disposed outside the first corrugation 31 is a circular second corrugation 33 whose centre point lies on the centre axis 27 of the subreflector 5*b*. The second corrugation 33 passes through all four sectors 19, 21, 23 and 25 and is thus common to the first and the second geometries 15 and 17. The first geometry 15 includes outwardly of the second corrugation 33 a first sloping reflector surface 35 that is disposed in the first sector. The first sloping reflector surface 35 is not perpendicular in relation to the centre axis 27, but defines an acute angle $\alpha$ (see FIG. 3) relative to said centre axis 27. In the illustrated case, the first sloping surface 35 has a conical shape. The first geometry 15 also includes a second sloping reflector surface 37 disposed in the second sector 21. The second sloping reflector surface 37 is opposite the first sloping reflector surface 35, although it is formed in a corresponding manner to the first sloping reflector surface 35 in other respects. The sloping reflector surfaces 35 and 37 vary linearly in the sectional view A—A of FIG. 3, although the sloping reflector surfaces 35 and 37 may, alternatively, be slightly curved in the section A—A and therewith be more dish-shaped than conical.

FIG. 3 is a sectional view of the subreflector 5*b* taken on the line B—B in FIG. 2. The section B—B is taken through another plane which includes the centre axis 27 of the subreflector 5*b* and which divides centrally in two the third and the fourth sectors 23 and 25. When using the subreflector 5*b*, the second plane constitutes an E-plane, in other words the second plane is parallel with the electric field strength of the electromagnetic field 50 reflected by the subreflector 5*b*. The section B—B illustrates the configuration of the second geometry 17. The second geometry 17 in the third sector 23 includes outside the spreader 29 and the first and the second corrugations 31 and 33 a circular third and fourth corrugation 39 and 41. The second geometry 17 in the fourth sector 25 also includes a fifth and a sixth corrugation 55 and 47, these corrugations being circular and opposite the third and the fourth corrugations 39 and 41.

The corrugations 33, 39, 41, 45 and 47 all pass in one and the same plane, which is perpendicular to the first and the second plane. The invention is not restricted to corrugations 33, 39, 41, 45 and 47 that pass in the same plane, and said corrugations may, alternatively, be disposed to pass in different planes, for instance so that the reflective structure of the subreflector 5*b* will be slightly conical.

As will be apparent from the section A—A, the second geometry has a configuration that corresponds to the reflective structure of the aforesaid hat feed subreflector. As before mentioned, the hat feed provides a radiation diagram in the E-plane that satisfies ETSI class 3, but, on the other hand, a radiation diagram in the H-plane that does not meet with the requirements of ETSI class 3. Accordingly, the subreflector 5*b* utilises in the second geometry 17 those advantages possessed by the hat feed subreflector in obtaining a radiation diagram that fulfils a predetermined quality in the second plane (E-plane). The first geometry 15 of the subreflector 5*b*, however, is designed to compensate for the deficiencies of the hat feed subreflector. Thus, the first geometry is designed especially to obtain with the reflector antenna 1 a radiation diagram that fulfils a predetermined quality also in the first plane (H-plane). In this regard, it is chiefly the sloping reflector surfaces 35 and 37 which enable the first geometry to compensate for the deficiencies of the second geometry with respect to the radiation diagram in the first plane (H-plane).

Figure 4:
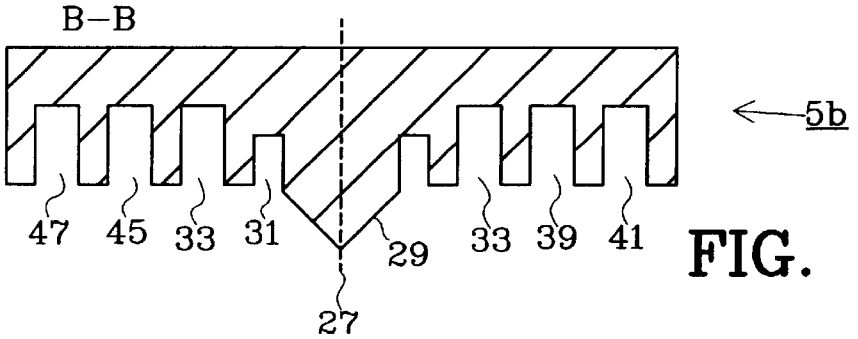
FIG. 4 is a second sectioned view of the subreflector.

When making measurements and calculations on a reflector antenna that included a subreflector as in the case illustrated in FIGS. 2 to 4, it was found that the reflector antenna fulfilled ETSI class 3 in the H-plane and also in the E-plane in respect of the frequencies 37.0, 38.25, 39.5 GHz. Reflection and antenna gain are also roughly the same as that obtained with more conventional subreflectors.

It will be understood that the first and the second geometries 15 and 17 are not restricted to precisely the configuration shown in FIGS. 2 to 4, and that the first and the second geometries may, alternatively, be configured in some other way so as to obtain a radiation diagram of predetermined quality in the first and the second planes respectively.

Figure 5:
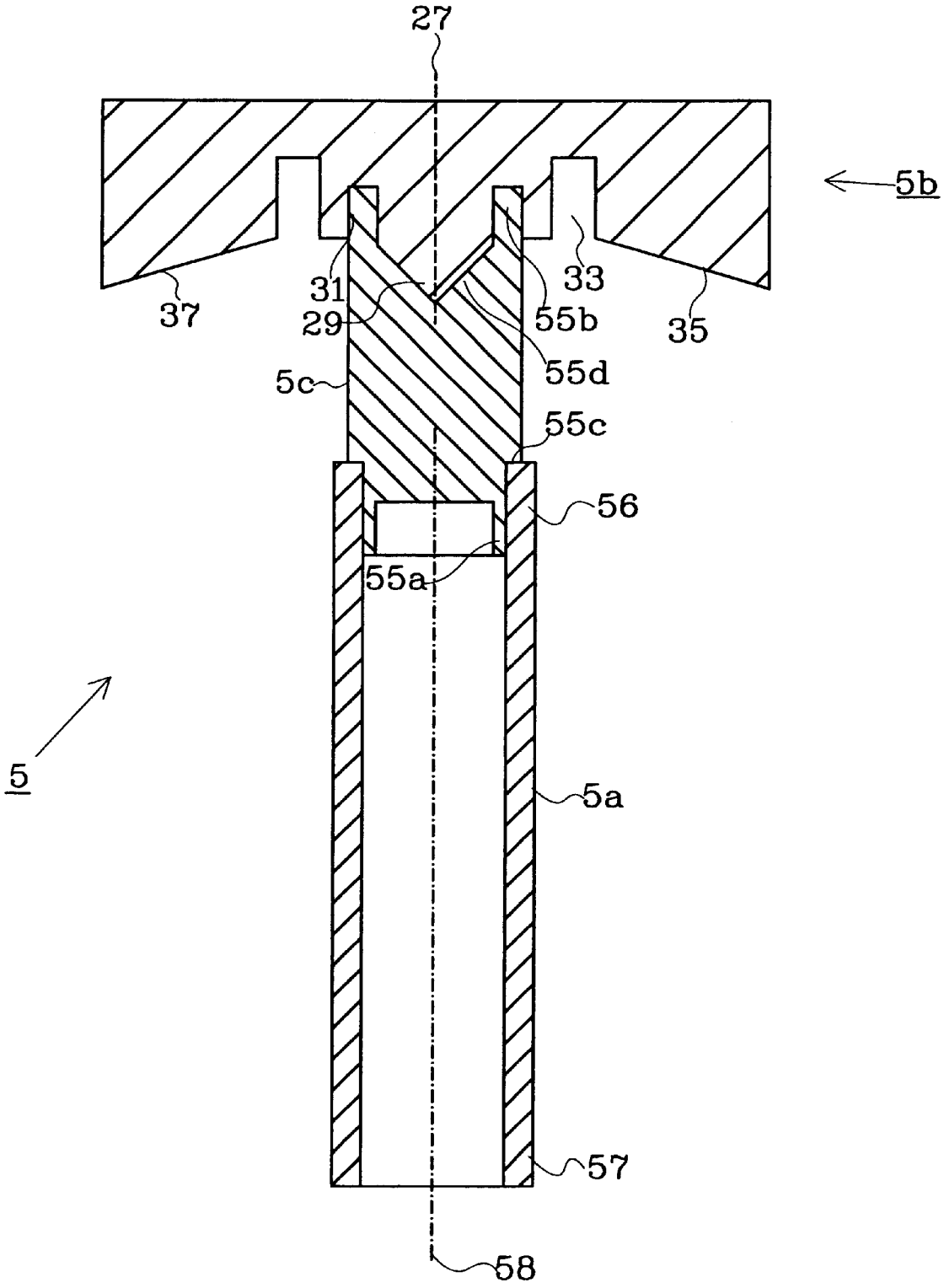
FIG. 5 is a sectioned view of a feed element belonging to the reflector antenna.

FIG. 5 is a sectional view which illustrates the feed 5 in more detail. The section shown in FIG. 5 is taken through a plane that corresponds to the first plane through which the section A—A in FIG. 3 is taken. In this example, the waveguide 5*a* is circular-cylindrical and includes a first and a second end 56 and 57, which are both open. The holder 5*c* includes a first tubular end 55*a* whose outer diameter corresponds substantially to an inner diameter of the waveguide 5*a*. The first tubular end 55*a* of the holder 5*c* is inserted into the waveguide 5*a* at the first end 56 of said waveguide. The holder 5*c* also includes a stop shoulder 55*c* that lies against the first end 56 of the waveguide 5*a*. The stop shoulder 55*c* and the first tubular end 55*a* enable the holder 5*c* to be readily placed in a predetermined position in relation to the waveguide 5*a*. The holder 5*c* also includes a second tubular end 55*b* which is adapted to fit in the first corrugation 31 of the subreflector 5*b*. The holder 5*c* also includes a centrally disposed recessed part 55*d* that has a conical shape corresponding to the shape of the spreader 29, said holder 5*c* being formed so that the spreader will lie against the walls of the recess 55*d*. The holder 5*c* is constructed so that the subreflector 5*b* will be located at a predetermined distance from the first end of the waveguide 5*a* and so that the centre axis 27 of the subreflector will coincide with a centre axis 58 of the waveguide 5*a*. In the illustrated case, the holder 5*c* is assumed to be made of PTFE (polytetrafluoroethylene), although it may alternatively consist of some other material found appropriate to this end by the person skilled in this art, for instance polystyrene. The design of the subreflector 5*b* enables the feed 5 to be made relatively short and compact.

The invention can be applied in all antenna applications found appropriate by the person skilled in this art. The invention, however, is particularly suitable for use in radio links where different polarisation directions are used to reduce interference.

What is claimed is:

1. A subreflector (5*b*) for a reflector antenna (1) comprising a reflective structure for reflection of a polarised electromagnetic field (50), characterised in that the reflective structure includes a first reflective geometry (15) which is configured to obtain a first radiation diagram with good suppression of side lobes in a first plane that includes a centre axis (27) of the subreflector (5*b*) and that is parallel with a magnetic field strength of the electromagnetic field (50); and in that the reflective structure includes a second reflective geometry (17) which is configured to obtain a second radiation diagram with good suppression of side lobes in a second plane that includes said centre axis (27) and that is parallel with an electric field strength of the electromagnetic field (50).

2. A subreflector according to claim 1, wherein the first geometry (17) includes at least one sloping reflector surface (35, 37).

3. A subreflector according to claim 2, wherein the sloping reflector surface (35, 37) has partially a conical shape.

4. A subreflector according to claim 1, wherein the first geometry includes at least one corrugation (31, 33) that passes in a curved path in a plane that is essentially perpendicular in relation to the first and the second plane.

5. A subreflector according to claim 4, wherein the corrugation (31, 33) in the first geometry (17) passes in a path that has an essentially constant radius of curvature.

6. A subreflector according to claim 1 wherein the second geometry includes a plurality of corrugations (31, 33, 39, 41, 45, 47) that pass in curved paths in planes which are essentially perpendicular in relation to the first and the second plane.

7. A subreflector according to claim 6, wherein the corrugations (31, 33, 39, 41, 45, 47) in the second geometry pass in paths that have essentially constant radii of curvature.

8. A subreflector according to claim 6, wherein the corrugations (31, 33, 39, 41, 45, 47) in the second geometry pass essentially in one and the same plane.

9. A subreflector according to claim 1, wherein the reflecting structure includes a spreader (29).

10. A feed for a reflector antenna, wherein the feed comprises:

a waveguide;

a subreflector; and a holder which is adapted to secure the subreflector in a predetermined position in relation to the waveguide, wherein the subreflector includes a reflective structure for reflection of a polarized electromagnetic field, in that the reflective structure includes a first reflective geometry which is configured to obtain a first radiation diagram with good suppression of side lobes in a first plane that includes a center axis of the subreflector and that is parallel with a magnetic field strength of the electromagnetic field; and in that the reflective structure includes a second reflective geometry which is configured to obtain a second radiation diagram with good suppression of side lobes in a second plane that includes said center axis and that is parallel with an electric field strength of the electromagnetic field.

11. A reflector antenna that includes a subreflector, wherein the subreflector is a subreflector which includes a reflective structure for reflection of a polarized electromagnetic field, in that the reflective structure includes a first reflective geometry which is configured to obtain a first radiation diagram with good suppression of side lobes in a first plane that includes a center axis of the subreflector and that is parallel with a magnetic field strength of the electromagnetic field; and in that the reflective structure includes a second reflective geometry which is configured to obtain a second radiation diagram with good suppression of side lobes in a second plane that includes said center axis and that is parallel with an electric field strength of the electromagnetic field.

12. A reflector antenna that includes a feed, wherein the feed is a feed which includes a reflective structure for reflection of a polarized electromagnetic field, in that the reflective structure includes a first reflective geometry which is configured to obtain a first radiation diagram with good suppression of side lobes in a first plane that includes a center axis of the subreflector and that is parallel with a magnetic field strength of the electromagnetic field; and in that the reflective structure includes a second reflective geometry which is configured to obtain a second radiation diagram with good suppression of side lobes in a second plane that includes said center axis and that is parallel with an electric field strength of the electromagnetic field.

* * * * *